US010267322B2

(12) United States Patent
Hermanson et al.

(10) Patent No.: US 10,267,322 B2
(45) Date of Patent: Apr. 23, 2019

(54) SUSPENDED FAN GENERATING RANDOM MOVEMENT OF A MAIN BODY

(71) Applicant: MR. CHRISTMAS INCORPORATED, New York, NY (US)

(72) Inventors: Terry Hermanson, New York, NY (US); Leslie Hermanson, Brooklyn, NY (US); Huang Meng-Suen, Hong Kong (CN)

(73) Assignee: MR. CHRISTMAS INCORPORATED, New York, NY (US)

( * ) Notice: Subject to any disclaimer, the term of this patent is extended or adjusted under 35 U.S.C. 154(b) by 971 days.

(21) Appl. No.: 14/327,850

(22) Filed: Jul. 10, 2014

(65) Prior Publication Data

US 2016/0010650 A1 Jan. 14, 2016

(51) Int. Cl.

| | |
|---|---|
| ***F04D 25/10*** | (2006.01) |
| ***F04D 19/00*** | (2006.01) |
| ***F04D 29/52*** | (2006.01) |
| ***F04D 29/00*** | (2006.01) |
| ***F04D 25/08*** | (2006.01) |

(52) U.S. Cl.

CPC ..... *F04D 19/002* (2013.01); *F04D 25/08* (2013.01); *F04D 25/084* (2013.01); *F04D 29/005* (2013.01); *F04D 29/522* (2013.01)

(58) Field of Classification Search

CPC ..... F04D 29/005; F04D 29/522; F04D 29/64; F04D 25/08; F04D 19/002

USPC ..... 446/178, 217, 201; 116/141

See application file for complete search history.

(56) References Cited

U.S. PATENT DOCUMENTS

| | | | | | |
|---|---|---|---|---|---|
| 333,611 | A | * | 1/1886 | Daveggio | A01M 29/06 116/143 |
| 810,900 | A | * | 1/1906 | Bartlet | A63H 33/006 248/629 |
| 1,295,618 | A | * | 2/1919 | Shaw | B64C 29/0033 416/110 |
| 1,375,270 | A | * | 4/1921 | Anderson | A61C 1/06 248/328 |
| 1,596,806 | A | * | 8/1926 | Ciller | F04D 25/10 415/121.3 |
| 3,290,817 | A | * | 12/1966 | Kravath | A63H 33/006 40/412 |
| 3,608,384 | A | * | 9/1971 | Hardin | B66C 13/08 294/81.4 |
| 3,927,482 | A | * | 12/1975 | Marcus | A61M 21/00 40/455 |

(Continued)

FOREIGN PATENT DOCUMENTS

| | | | |
|---|---|---|---|
| CN | 101649840 A | * | 2/2010 |
| CN | 201884306 U | * | 6/2011 |

*Primary Examiner* — Vishu K Mendiratta

(74) *Attorney, Agent, or Firm* — Venable LLP

(57) ABSTRACT

An assembly has a base, a support, a cord, a main body, and a random movement article. The support has a first end and a second end, and the first end is attached to the base. The cord is attached to the second end of the support, and the main body is suspended from the support by the cord. The main body includes a fan configured to produce airflow in an airflow direction. The random movement article is secured to the main body and, when the fan is producing airflow, creates random movement of the main body.

12 Claims, 5 Drawing Sheets

(56) References Cited

U.S. PATENT DOCUMENTS

| | | | | | |
|---|---|---|---|---|---|
| 3,945,769 | A * | 3/1976 | Sanderson | F04D 25/105 | 416/79 |
| 4,207,696 | A * | 6/1980 | Hyman | A63H 33/006 | 40/457 |
| 5,703,564 | A * | 12/1997 | Begum | G09F 19/02 | 340/815.4 |
| 7,244,179 | B2 * | 7/2007 | Chien | F24F 7/007 | 416/100 |

* cited by examiner

SUSPENDED FAN GENERATING RANDOM MOVEMENT OF A MAIN BODY

FIELD OF THE INVENTION

This invention generally relates to mechanical decorations. More particularly, this invention relates to a suspended fan generating random movement of a main body.

BACKGROUND OF THE INVENTION

Novelty items, such as mechanical decorations, are popular for decorating homes, office spaces, and the like according to one's interests. Such interests include sports teams, movies, music, etc., and some of these decorations move as a result of a mechanical design. These decorations may also be displayed in a variety of ways including mounted to a wall or displayed on a desk. This invention is directed to a power operated fan capable of generating random movement of a main body, which can take many forms.

SUMMARY OF THE INVENTION

In one aspect, the invention relates to an assembly having a base, a support, a cord, a main body, and a random movement article. The support has a first end and a second end, and the first end is attached to the base. The cord is attached to the second end of the support, and the main body is suspended from the support by the cord. The main body includes a fan configured to produce airflow in an airflow direction. The random movement article is secured to the main body and, when the fan is producing airflow, creates random movement of the main body.

In another aspect, the invention relates to an assembly having a base, a support, a cord, and a main body. The support has a first end and a second end, and the first end is attached to the base. The cord is attached to the second end of the support, and the main body is suspended from the support by the cord. The main body includes a fan configured to produce airflow in an airflow direction. The main body also includes an airflow-directing surface attached to the main body. The airflow-directing surface is positioned at an angle to redirect a portion of the airflow. The portion of the airflow impinges upon the airflow-directing surface and is redirected by the airflow-directing surface to impact a force on the airflow-directing surface and cause rotation of the main body.

In yet another aspect, the invention relates to an assembly having a base, a support, a cord, and a main body with a central axis. The support has a first end and a second end, and the first end is attached to the base. The cord is attached to the second end of the support, and the main body is suspended from the support by the cord. The cord is attached to a top side of the main body and extends in a direction generally perpendicular to the central axis. The main body includes an airflow-directing surface attached to the main body to cause a generally random movement of the main body. The main body also includes an electric motor. The electric motor has a rotational axis and a shaft. The rotational axis is coincident with the central axis and the shaft rotates about the rotational axis. Vanes extend from the shaft and are configured to produce airflow in a direction generally parallel to the central axis. A motion destabilizing article is attached to the main body to cause a generally random movement of the main body.

These and other aspects of the invention will become apparent from the following disclosure.

DETAILED DESCRIPTION OF THE PREFERRED EMBODIMENTS

Figure 1:
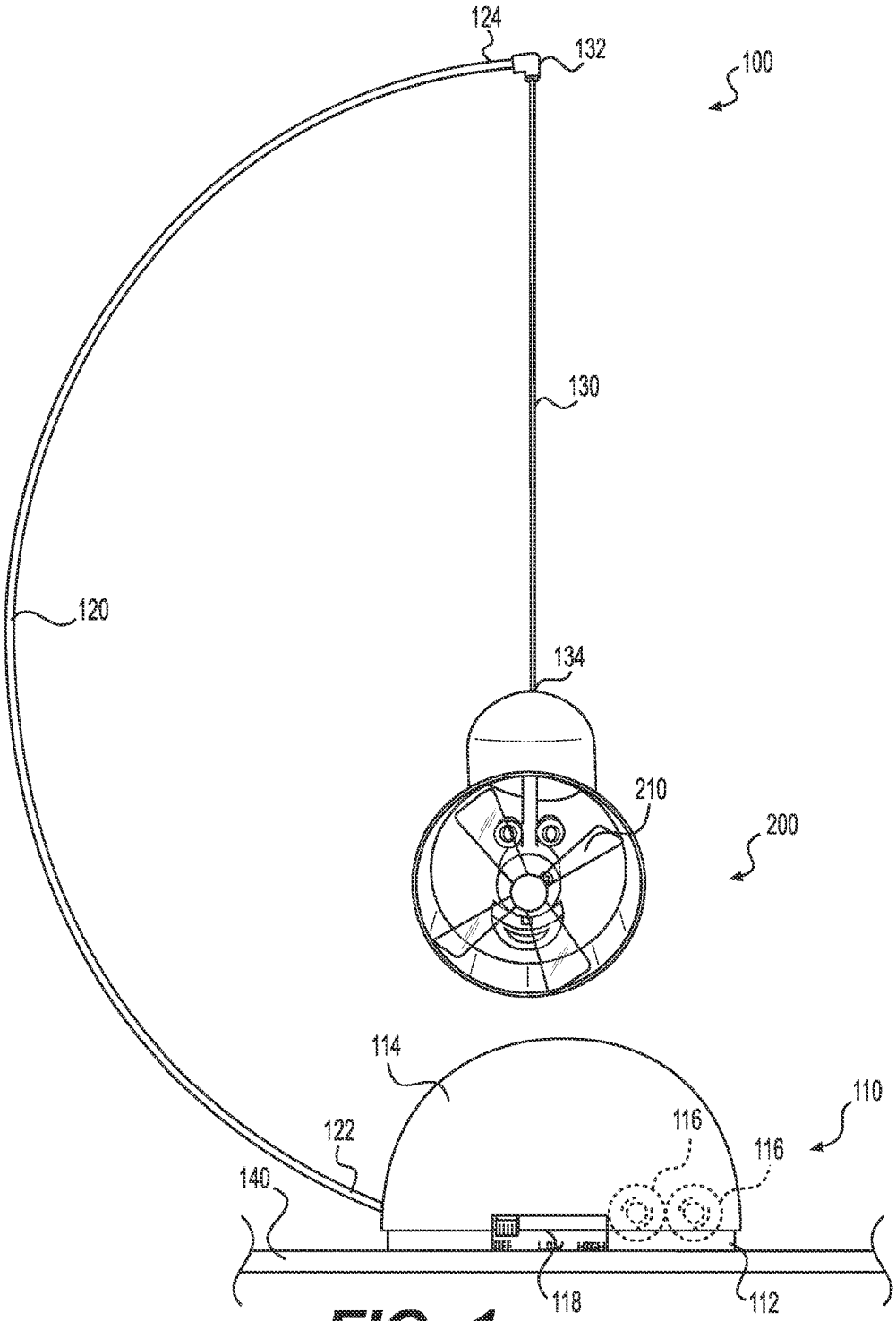
FIG. 1 shows an apparatus according to a preferred embodiment of the invention.

FIG. 1 shows an assembly 100 according to a preferred embodiment of the invention. The assembly includes a base 110, a support 120, a cord 130, and a main body 200. One end 122 of the support 120 is secured to the base 110, and the cord 130 is attached to the other end 124 of the support 120. The main body 200 is attached to the cord 130, and the cord 130 thus suspends the main body 200 from the support 120. The main body 200 includes a fan 210 that is configured to produce airflow 220 (see FIGS. 5 and 6), and when the fan 210 is in operation, the main body 200 moves in a generally random pattern.

In the embodiment shown in FIG. 1, the base 110 is configured to sit on a generally horizontal surface 140, for example, a table or a desk. The base 110 is a hemisphere that includes a flat bottom plate 112 and a base cover 114. Those skilled in the art will recognize that the base 110 may take any number of shapes or designs. In the current embodiment, the flat bottom plate 112 is made from an injection molded plastic such as polypropylene or high density polyethlyene, and the base cover 114 is made from a synthetic rubber such as styrene-butadiene rubber. Those skilled in the art will recognize that the base 110 may be made from any suitable material including metals, ceramics, or other plastics.

The base 110 should be suitably sized to be stable when the main body 200 is moving and to prevent the assembly 100 from being easily knocked over by inadvertent contact. Stability may also be provided by adding weight to the base 110 and thus lowering the center of gravity of the assembly 100. The center of gravity is preferably positioned low in the base 110 directly below an elbow 132, or other suitable connection, where the cord 130 attaches to the support 120. Those skilled in the art will recognize that weight may be added to the base in any number of ways. In the current embodiment, the fan 210 is battery operated, with batteries 116 housed in the base 110. The flat bottom plate 112 includes a battery cover (not shown) to allow the replacement of the batteries 116. The batteries 116 may be positioned in other locations such as in the main body 200. The assembly 100 may be powered by other sources including, for example, an electrical outlet, a mechanical winding mechanism, or solar energy.

Figure 2:
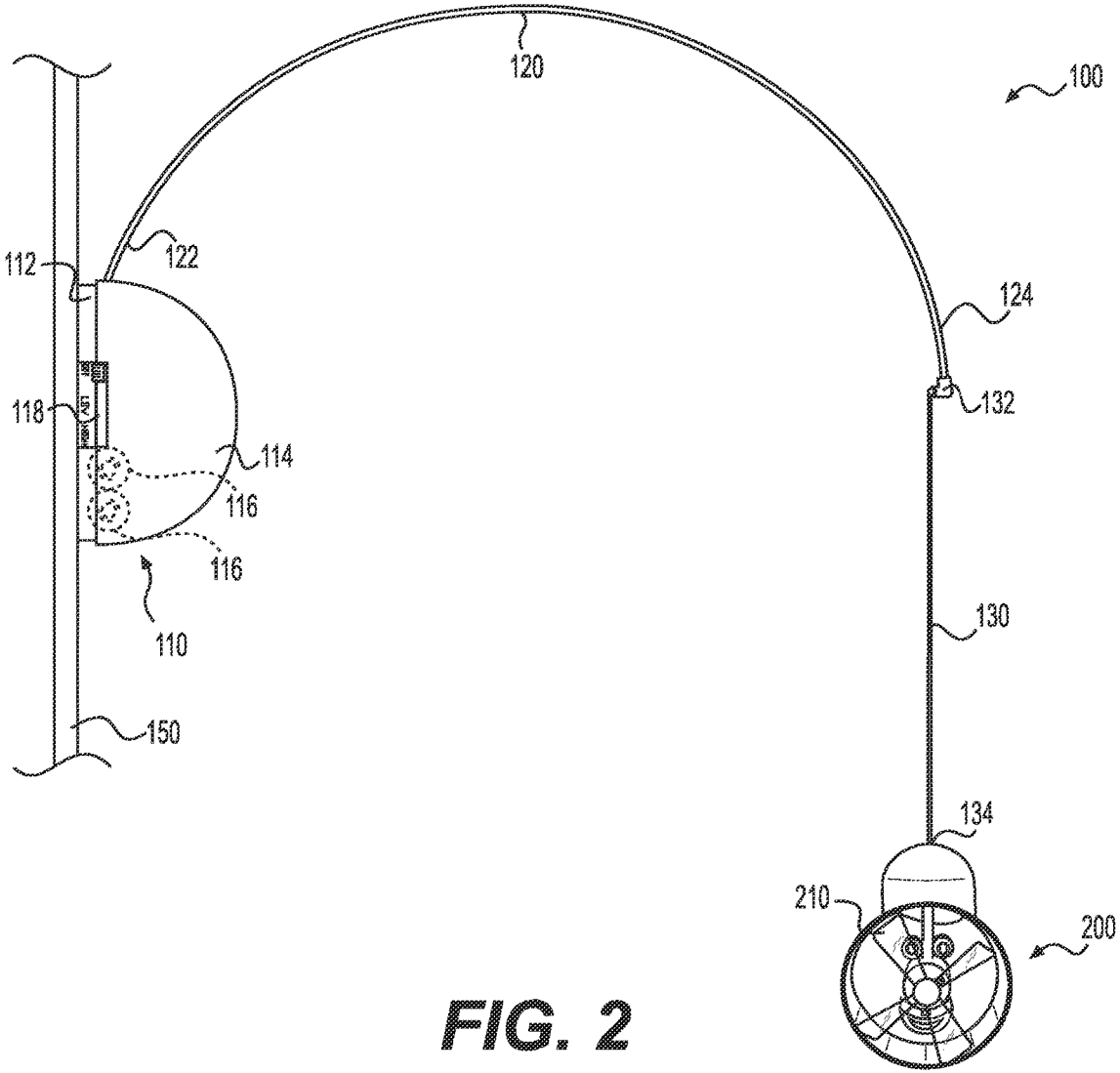
FIG. 2 shows the apparatus of FIG. 1 in an alternate mounting position.

FIG. 2 shows an alternate mounting configuration for the apparatus 100. In FIG. 2, the apparatus 100 is shown mounted to a vertical surface 150 such as a wall. The base 110 may be configured to attach to the vertical surface 150 using any suitable means known in the art. The base 110 may be mounted to the vertical surface 150 using, for example, screws, adhesives, or magnets. In this mounting configuration, the base 110 is sized to ensure that the method used to mount the base to the wall has sufficient strength to support the weight of the apparatus 100 and any additional forces generated by either the motion of the main body 200 or inadvertent contact. Those skilled in the art will recognize that such considerations include, for example, the surface area of the base 110 if adhesive is used, and both tensile and shear tear out strength of the flat bottom plate 112 if screws are used.

The base 110 also includes a switch 118 to operate the fan 210. In this embodiment, the switch 118 is a slide switch with three settings: off, low speed, and high speed. Any suitable switch known in the art may be used including toggle switches and rotary switches. The switch 118 preferably allows for variable speed settings of the fan 210.

One end, a first end 122, of the support 120 attaches to the base 110. Any suitable means for attaching the support 120 to the base 110 may be used including, for example, screws. The cord 130 is attached to the other end, second end 124, of the support at elbow 132. In this embodiment, the support 120 is a hollow aluminum tube, and an electrical cord can be routed inside the support 120 from the power supply in the base 110 to the fan 210.

Figure 6:
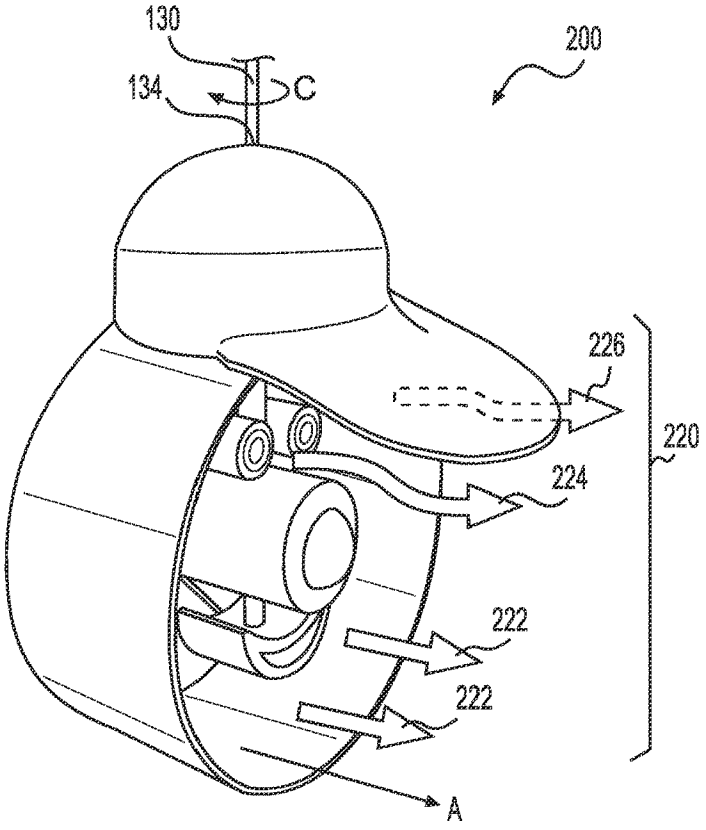
FIG. 6 is a perspective view of the main body of the apparatus shown in FIG. 1.

The support 120 should have suitable strength and rigidity to suspend the main body 200 but is also preferably flexible. The second end 124 of the support is preferably allowed to vibrate or move in vertical and horizontal directions (in the mounting configuration shown in FIG. 1), as shown in FIG. 6. And, once displaced, preferably moves toward its original (neutral) position 126. Without intending to be bound to any theory and as will be discussed further below, this motion of the support 120 contributes to the generally random motion of the main body 200. The material used for the support 120 and the wall thickness of the support 120 contributes to the amount of flexibility in the support and the magnitude of displacement of the second end 124 of the support 120. The shape of the support 120 also contributes to the rigidity of the support 120. In this non-limiting embodiment, the support 120 has an elliptical arch shape. In addition to providing a suitable rigidity, the elliptical arch shape of the support 120 keeps the support 120 from interfering with a swinging motion of the main body 200. Those skilled in the art will recognize that other suitable shapes, materials of construction, and geometrics may be used for the support 120 without deviating from the scope of the invention.

The cord 130 is attached to the support 120 at the elbow 132 and suspends the main body 200 from the support 120. The cord 130 is attached to the main body 200 at attachment point 134. Any suitable cord may be used, and it should have sufficient strength to support the main body 200 without breaking. In the preferred embodiment, the cord 130 is a coated electrical cord. In this way the cord 130 not only supports the main body 200, but also provides electrical power from the power supply in the base 110 to the fan 210. The length of the cord 130 is preferably set to provide a clearance between the bottom of the main body 200 and the base 110. This allows the main body 200 to swing when the tan 210 is in operation. A longer cord 130 is preferred because the longer the cord 130 is, the less force is required to produce a noticeable swinging motion in the main body 200.

Figure 7:
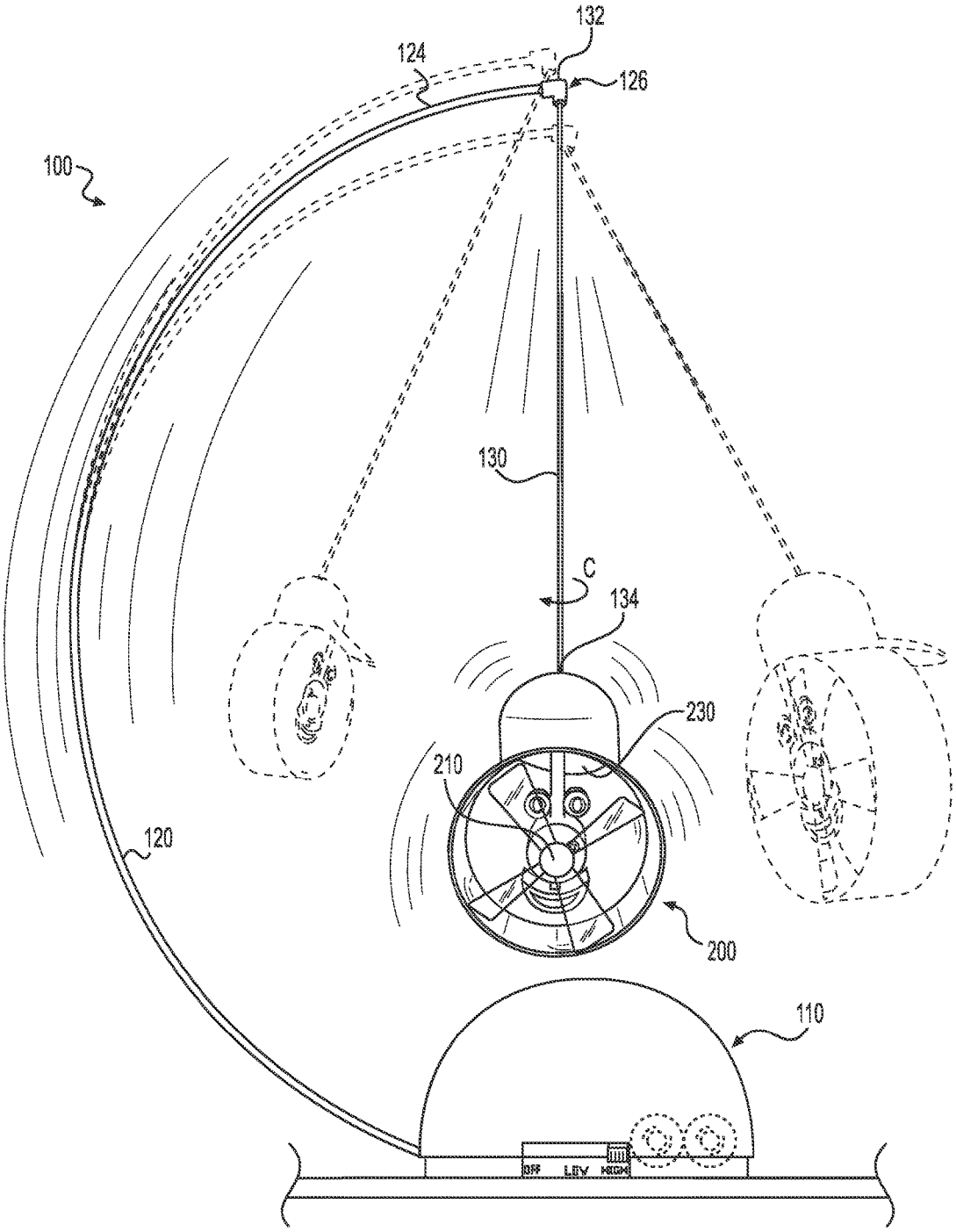
FIG. 7 shows the apparatus of FIG. 1 with broken lines to illustrate movement of the main body.

The main body 200 will now be described with reference to FIGS. 3-7. FIGS. 3-6 are detailed views of the main body 200. FIG. 7 depicts movement of the apparatus 100. In the preferred embodiment, the main body 200 is in the shape of a cylinder with a central axis 202. The main body 200 in this embodiment is designed to look like a lace with a ball cap on top. Those skilled in the art will recognize that the main body 200 may be designed to depict any suitable shape.

The main body 200 is preferably made from a light weight plastic such as polypropylene or high density polyethylene. A light weight material is preferred to reduce the force required to be produced by the fan 210 and an airflow-directing surface 230 to produce the motion, of the main body 200, as discussed below. Those skilled in the art will recognize that the main body 200 may be made from any suitable material including metals, ceramics, or other plastics.

Figure 3:
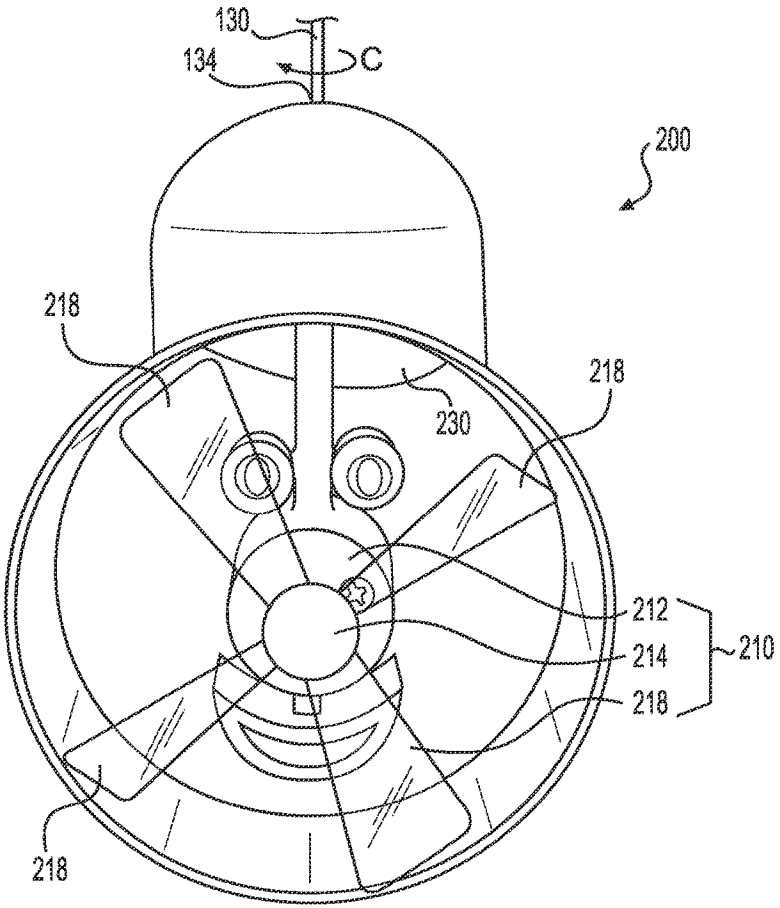
FIG. 3 is a front view of a main body of the apparatus shown in FIG. 1.

The main body 200 includes a fan 210 to produce airflow 220. The fan 210 preferably has an electric motor 212 and a shaft 214. The electric motor 212 has a rotational axis 216 about which the shaft 214 rotates. In the preferred embodiment, the rotational axis 216 is coincident with the central axis 202 of the main body 200. As illustrated in FIG. 3, the shaft 214 rotates in a clockwise direction, but of course could rotate in a counterclockwise direction. The fan has four vanes 218 attached to the shaft 214. The vanes 218 are oriented such that the airflow 220 is produced in an airflow direction A. As shown, the airflow direction A is from the front of the main body 200 to the back of the main body 200. In this way the main body 200 can be pulled forward and up. When a downward gravitational force exceeds the force produced by the fan 210, the main body 200 begins to swing in the opposite direction. The main body 200 thus rotates or swings about the elbow 132 where the cord 130 attaches to the second end 124 of the support 120. The rotation of the shaft 214 or the orientation of the vanes 218 could be reversed to produce airflow 220 in the opposite direction. When reversed, the fan 210 pushes, instead of pulls, the main body 200. The fan 210 may have multiple speeds. For example, the fan 210 may have a high and low speed. In the high speed, the shaft 214 rotates faster resulting in greater airflow speeds and greater resultant forces.

Figure 5:
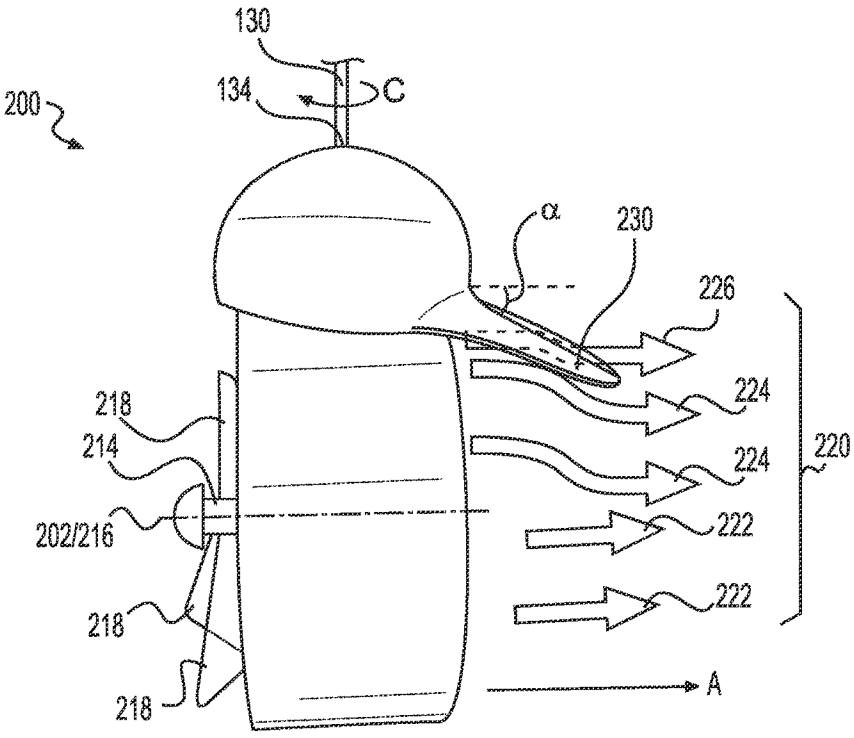
FIG. 5 is a side view of the main body of the apparatus shown in FIG. 1.

The main body 200 includes features that produce a generally random motion. Herein, these features are generally referred to as a random movement article or a motion destabilizer. The random movement article creates various forces on the main body that, in combination with other forces exerted on the main body, produces a generally random movement. In the preferred embodiment, the airflow-directing surface 230 is such an article and, in this embodiment takes the form of a bill of a cap. The airflow-directing surface is asymmetrically attached to a top portion of the main body 200. The airflow-directing surface extends generally in direction A from the attachment point 134 and at a downward angle $\alpha$ into the airflow as shown in FIG. 5. The downward angle $\alpha$ is preferably between about 5° and about 30°, and more preferably about 25°, but of course any angle capable of redirecting the air flow is sufficient. Portions 224, 226 of the airflow thus impinge upon the airflow-directing surface and are redirected as a result. Other portions 222 of the airflow are not as impeded by the airflow-directing surface, and they travel more directly in direction A.

Figure 4:
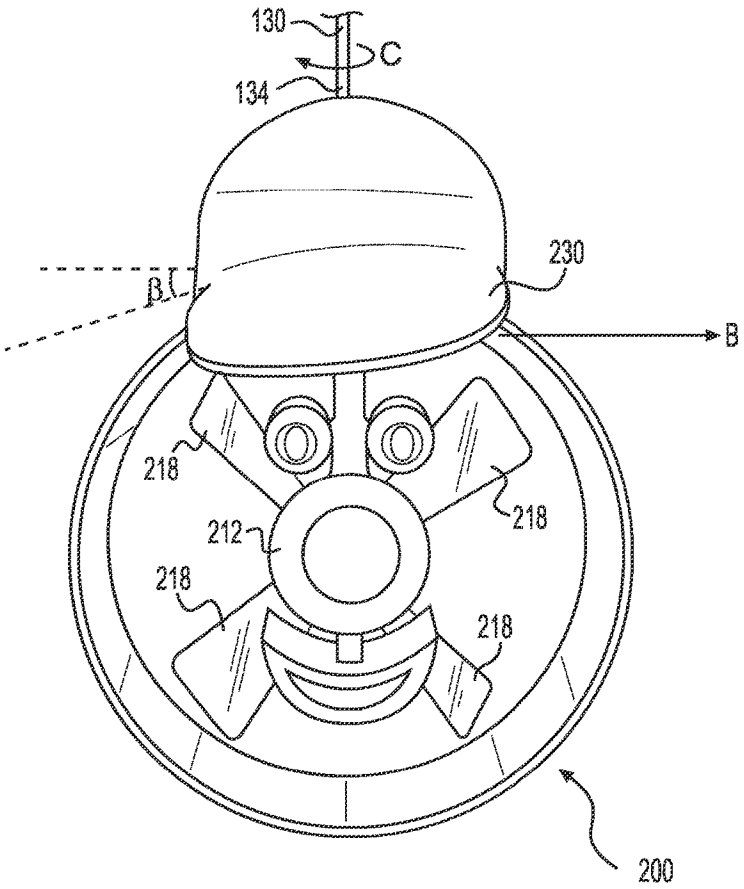
FIG. 4 is a rear view of the main body of the apparatus shown in FIG. 1.

The airflow-directing surface 230 is also oriented at a sideward angle $\beta$ as shown in FIG. 4. The airflow-directing surface 230 thus extends further into the airflow on the left side of the main body 200 (when the main body 200 is viewed from the rear, as in FIG. 4). The sideward angle β is preferably, but not limited to, between about 5° and about 30°, and more preferably about 25°. Consequently, the portion 224 of the airflow impinging on the left side of the airflow-directing surface 230 is deflected with a larger magnitude than the portion 226 of the airflow impinging on the right side. A resultant force imparted to the main body because of the airflow impinging on the airflow-directing surface is thus larger on the left side than the right. Further, the sideward angle β redirects the portion of the airflow impinging on the airflow-directing surface 230 in a direction with a vector component in direction B. As a result, a force is imparted to the main body 230 in a direction opposite to direction B.

The combination of these resultant forces causes the main body to rotate in direction C about the attachment point 134 of the cord 130 to the main body 200. The asymmetrical orientation of the airflow-directing surface in the airflow thus contributes to the generally random motion of the main body 200. The resultant forces, as will be appreciated, cause the fan-operated main body to move, i.e., swing, in a destabilized, random motion, thus creating an asymmetrical movement, as opposed to the steady back and forth motion of a balanced main body.

Destabilized, random motion of the main body can be accomplished in alternative ways without departing from the scope of the invention. For example, the angled bill can be positioned in the front or even on a side of the main body to cause asymmetrical movement. Of course, other objects can be attached to the main body, either within its framework or outside thereof, to create the desired asymmetrical movement.

If the cord 130 is attached to the main body 200 with a swivel, the main body may spin about. Alternatively, the cord 130 may be non-rotatably attached to the main body. When the cord 130 is non-rotatably attached to the main body, the rotation in direction C will cause a twist in the cord 130. As a result, a restoring force produced by the twist will overcome the force produced on the main body by the airflow-directing surface 230 causing the main body to rotate in a direction opposite to direction C. Without intending to be bound to any theory, rotation in direction C and in the opposite direction contributes to the generally random motion of the main body.

In another embodiment, the random movement article may be unbalanced in weight such as where the weight is asymmetrically distributed on a top portion of the main body 200 about the attachment point 134. In such a distribution, additional weight may be located in direction A from the attachment point 134. Weight may also be distributed to one side or another (a direction perpendicular to the airflow direction) to create an unbalanced weight distribution, resulting in asymmetrical movement. As the main body 200 swings, it will be influenced by the weight and thus contribute to the generally random motion of the main body 200. Those skilled in the art will recognize that other ways of creating an unbalanced weight distribution are possible without deviating from the scope of the invention.

As discussed above, the second end 124 of the support 120 is preferably allowed to vibrate or move in a vertical direction, as shown in FIG. 7. As the fan 210 pulls the main body 200 forward, the second end 124 of the support 120 may be displaced downward from an original (or neutral) position 126. As the main body 200 swings, the second end 124 of the support begins to move toward the neutral position 126 because of the flexibility in the support 120. The momentum of the movement may result m the second end 124 of the support 120 moving upwards from the neutral position 126. Consequently, the main body 200 may also have a vertical motion or bounce imparted to it. In concert with the additional directions of motion discussed above, the main body 200 moves with a generally random motion, i.e., asymmetrical movement. The broken lines in FIG. 7 show example positions of the main body 200 as it moves with this generally random motion.

The embodiments discussed herein are examples of preferred embodiments of the present invention and are provided for illustrative purposes only. They are not intended to limit the scope of the invention. Although specific configurations, structures, materials, etc. have been shown and described, such are not limiting. Modifications and Variations are contemplated within the scope of the invention, which is to be limited only by the scope of the accompanying claims.

What is claimed is:

1. An assembly comprising:

a base;

a support having a first end and a second end, the first end of the support attached to the base;

a cord attached to the second end of the support; and a main body, the main body being suspended from the support by the cord, with the main body including:

(i) a fan having vanes configured to produce airflow in an airflow direction and (ii) an asymmetric article attached to the main body and asymmetrically extending into the airflow such that the asymmetric article is configured to create random movement of the main body as the airflow produced by the fan contacts the asymmetric article.

2. The assembly of claim 1, wherein the support has an elliptical arch shape.

3. The assembly of claim 1, wherein the support is flexible, the second end of the support being configured to deflect with movement of the main body.

4. The assembly of claim 1, wherein the base is configured to sit on a generally horizontal surface.

5. The assembly of claim 1, wherein the base is configured to mount to a generally vertical surface.

6. The assembly of claim 1, wherein the cord lies in a plane and the plane in which the cord lies extends in the airflow direction, and wherein the asymmetric article is asymmetrical about the plane in which the cord lies.

7. An assembly comprising:

a base;

a support having a first end and a second end, the first end of the support attached to the base;

a cord attached to the second end of the support; and a main body, the main body being suspended from the support by the cord, with the main body including:

(i) a fan having vanes configured to produce airflow in an airflow direction; and (ii) an article having an airflow-directing surface attached to the main body, the airflow-directing surface extending into the airflow produced by the vanes of the fan and positioned at an angle to redirect a portion of the airflow, the portion of the airflow impinging upon the airflow-directing surface and being redirected by the airflow directing surface imparting a force on the airflow-directing surface to cause random movement of the main body.

8. The assembly of claim 7, wherein the main body further includes a top side having a top side surface, the cord being attached to the top side surface, and the airflow-directing surface is attached to the top side of the main body and extends at a downward angle into the airflow produced by the vanes of the fan.

9. The assembly of claim 8, wherein the downward angle is between about 5° and about 30° from the top side surface.

10. The assembly of claim 8, wherein the airflow-directing surface is oriented at sideward angle, the sideward angle being an angle from horizontal about an axis parallel to the airflow direction.

11. The assembly of claim 10, wherein the sideward angle is between about 5° and about 30° from horizontal.

12. The assembly of claim 7, wherein the airflow-directing surface causes the main body to rotate in a first direction, and the cord is non-rotatably attached to the main body such that, after the main body is rotated in the first direction, the cord rotates the main body in a direction opposite to the first direction.

* * * * *